US007558521B2

(12) United States Patent
Ohhara et al.

(10) Patent No.: US 7,558,521 B2
(45) Date of Patent: Jul. 7, 2009

(54) ROLLER, FIXING DEVICE, AND IMAGE FORMING DEVICE

(75) Inventors: Hideaki Ohhara, Kanagawa (JP); Motofumi Baba, Kanagawa (JP); Yasutaka Naito, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 11/730,444

(22) Filed: Apr. 2, 2007

(65) Prior Publication Data

US 2008/0031663 A1 Feb. 7, 2008

(30) Foreign Application Priority Data

Aug. 7, 2006 (JP) ..... 2006-214686

(51) Int. Cl.
*G03G 15/20* (2006.01)

(52) U.S. Cl. ..... 399/333

(58) Field of Classification Search ..... 399/107, 399/122, 320, 328, 330, 331, 332, 333, 334; 219/216; 492/18, 53, 56
See application file for complete search history.

(56) References Cited

U.S. PATENT DOCUMENTS

| | | | | |
|---|---|---|---|---|
| 4,823,689 | A * | 4/1989 | Kishino et al. | 100/155 R |
| 5,195,228 | A * | 3/1993 | Fukunaga et al. | 492/56 |
| 5,264,902 | A * | 11/1993 | Suwa et al. | 399/333 |
| 5,532,808 | A * | 7/1996 | Saito et al. | 399/333 |

FOREIGN PATENT DOCUMENTS

| | | |
|---|---|---|
| JP | 62-220711 | 9/1987 |
| JP | 2-282283 | 11/1990 |
| JP | 3-266873 | 11/1991 |
| JP | 6-3995 | 1/1994 |
| JP | 07-134509 | 5/1995 |
| JP | 7-295418 | 11/1995 |
| JP | 2005-164931 | 6/2005 |

* cited by examiner

*Primary Examiner*—Hoan H Tran
(74) *Attorney, Agent, or Firm*—Morgan, Lewis & Bockius LLP

(57) ABSTRACT

A roller includes: a columnar metal core; and a layer that covers, to a predetermined thickness, an outer circumferential surface of the metal core, the layer including bubbles inside, and being provided with one or more cuts penetrating the bubbles through each of end surfaces of the layer.

5 Claims, 7 Drawing Sheets

ROLLER, FIXING DEVICE, AND IMAGE FORMING DEVICE

CROSS-REFERENCE TO RELATED APPLICATIONS

This application is based on and claims priority under 35 USC 119 from Japanese Patent Application No. 2006-214686 filed on Aug. 7, 2006.

BACKGROUND

1. Technical Field

The present invention relates to a roller, fixing device, and image forming device.

2. Related Art

There is known a fixing method for fixing a toner image in an electrophotographic image forming device. The fixing method uses a press roller having an outer circumferential surface where a layer using material such as rubber or the like having bubbles inside is formed. Hereinafter such a layer is referred to as an "elastic layer". In the fixing method, the press roller is pressed against a fixing member, which is driven to rotate, thereby to compress the elastic layer of the press roller. In this manner, a contact area is formed so as to have a width in a circumferential direction of the press roller. A recording medium is conveyed to enter into the contact area, with a toner image formed on the recording medium. The toner image is melted and pressed, so that the toner image is fixed to the recording medium.

SUMMARY

According to one aspect of the invention, a roller includes: a columnar metal core; and a layer that covers, to a predetermined thickness, an outer circumferential surface of the metal core, the layer including bubbles inside, and being provided with one or more cuts penetrating the bubbles through each of end surfaces of the layer.

BRIEF DESCRIPTION OF THE DRAWINGS

An exemplary embodiment of the present invention will be described in detail based on the following figures, wherein.

DETAILED DESCRIPTION

An exemplary embodiment of the invention will now be described with reference to the drawings.

Figure 1:
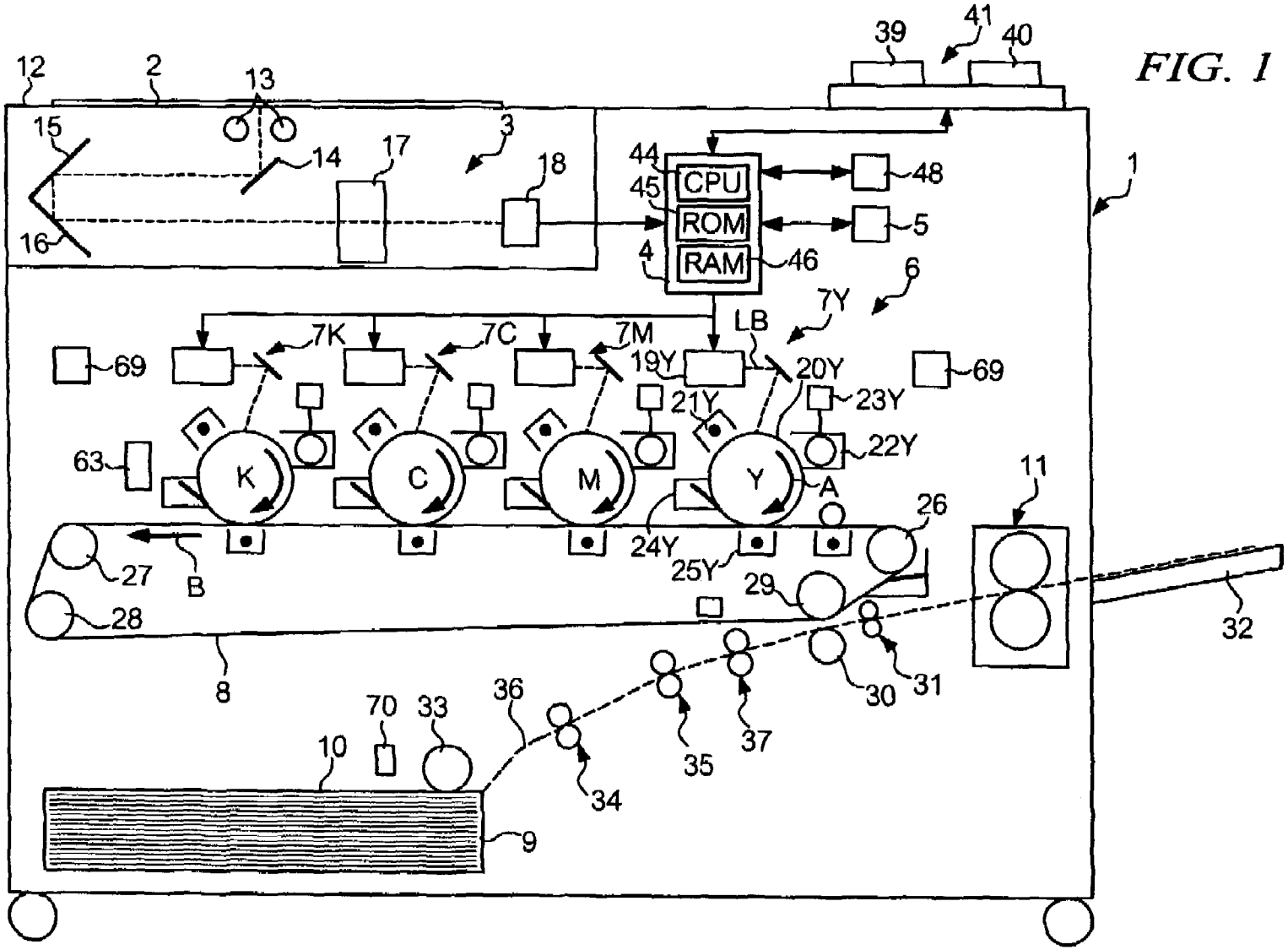
FIG. 1 shows an image forming device 1 having a fixing device 100.

FIG. 1 shows an image forming device 1 including a fixing device 100 according to the present embodiment. The image forming device 1 has a function of acting as a copying machine.

A controller 4 controls respective units of the image forming device 1 by executing a program stored in a memory 5.

An instruction reception unit 41 includes a display screen 39 and a key input unit 40 which includes a start key, stop key, reset key, and ten-keys. Using the screen and keys, a user may input instructions to the image forming device 1.

A communication I/F (interface) 48 is connected to a network (not shown in the figures) and relays data exchanged between the image forming device 1 and other devices.

An image input unit 12 optically reads a document and outputs an electric signal. Based on this signal, the controller 4 generates image data sets respectively expressing images in colors of Y (Yellow), M (Magenta), C (Cyan), and K (black).

An image output unit 6 includes image forming engines 7Y, 7M. 7C, and 7K, a transfer belt 8, etc. The image forming engines 7Y, 7M, 7C, and 7K respectively form toner images for the colors Y, M, C, and K. Since all of the image forming engines have a common structure, only the image forming engine 7Y will now be described.

A photosensitive drum 20Y is a photosensitive member having a round cylindrical shape, and which has a light-conductive outer circumferential surface. An electrostatic charging device 21Y electrostatically charges a surface of the photosensitive drum 20Y to a predetermined electric potential. An exposure device 19Y is an optical scanning system which emits an exposure beam LB to the photosensitive drum 20Y Accordingly, an electrostatic latent image based on image data is formed on the surface of the photosensitive drum 20Y.

A developing device 22Y causes toner to stick to the electrostatic latent image to thereby form a toner image on the surface of the photosensitive drum 20Y The toner image formed on the surface of the photosensitive drum 20Y is transferred to a surface of a transfer belt 8, by effect of an electric field. The transfer is referred to as "first transfer". The electric field is generated by a voltage applied to a transfer device 25Y.

The image forming engines 7M, 7C, and 7K also form toner images in respectively corresponding colors. The toner images are transferred layered on one another to the transfer belt 8.

After the toner images are formed on the surface of the transfer belt 8, a sheet feed roller 33 is driven to rotate, and feeds sheet-type recording media 10 one after another. The toner images on the transfer belt 8 are transferred to a surface of a recording medium 10 by an electric field and by effect of a load. The transfer is referred to as "second transfer". The electric field is generated by a voltage applied to a transfer roller 30. The load is applied from the transfer roller 30 pressed against the transfer belt 8

The recording medium 10 to which the toner images have been transferred is guided to the fixing device 100. The fixing device 100 heats and presses the recording medium 10, to fix the toner images to the surface of the recording medium 10. The recording medium 10 to which the toner images have been transferred is discharged to a sheet discharge unit 32.

Figure 2:
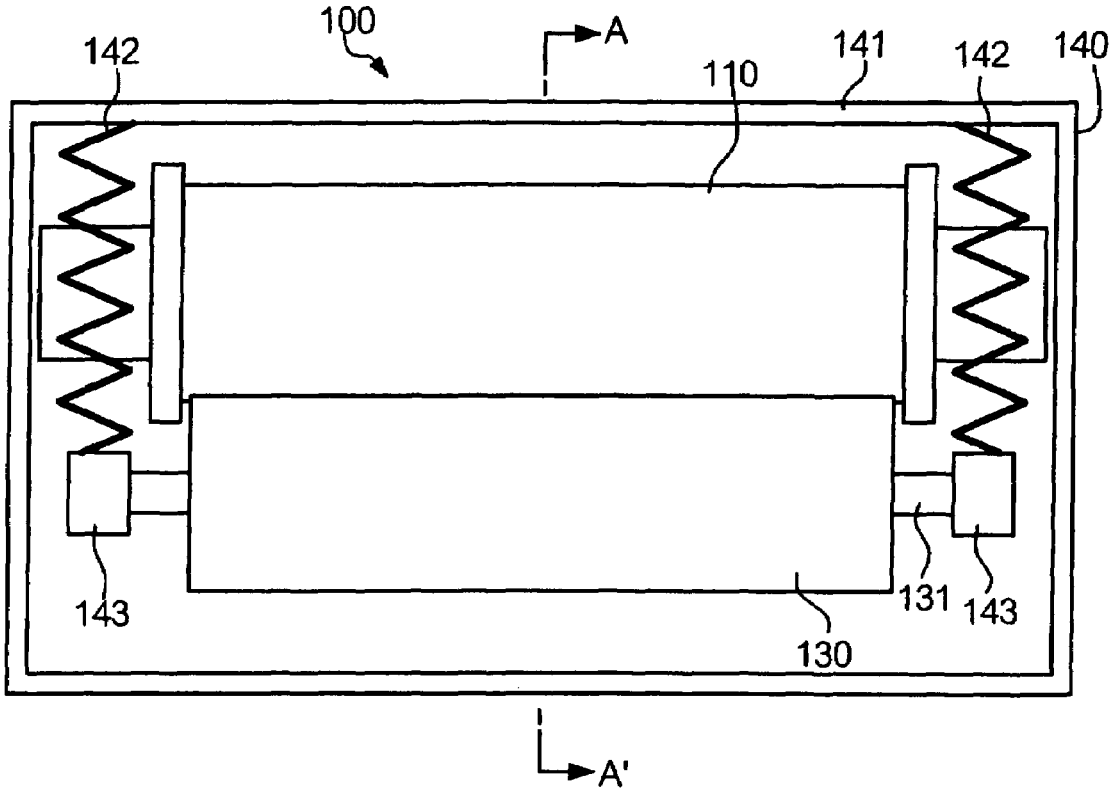
FIG. 2 shows the fixing device 100, viewed from a direction of conveying recording media.
Figure 3:
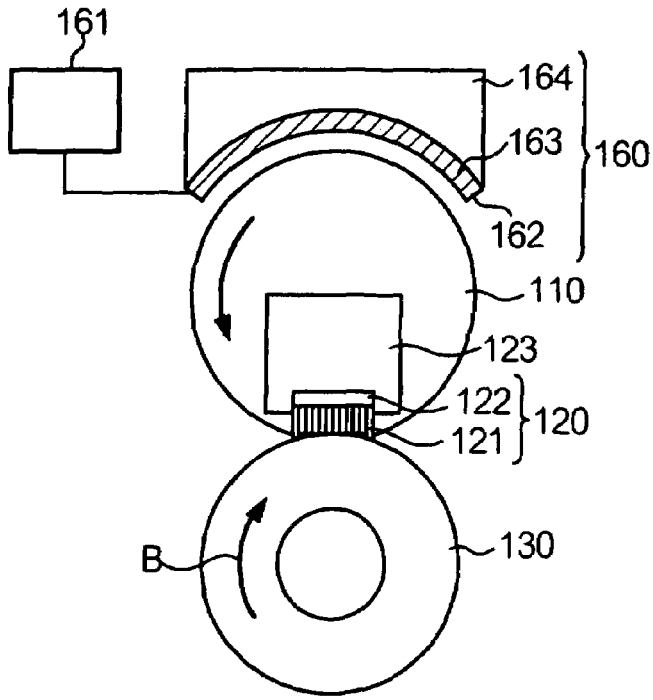
FIG. 3 is a cross-sectional view cut along a line A-A' in FIG. 2.

FIG. 2 shows the fixing device 100 from a direction of conveying the recording medium 10. FIG. 3 is a sectional view cut along a line A-A' in FIG. 2. The fixing device 100 uses an electromagnetic induction heating system.

The fixing device 100 is configured so as to include a fixing belt 110, pad 120, press roller 130, magnetic field generation unit 160, and the like in a casing 140.

The magnetic field generation unit 160 generates alternating magnetic flux for causing a heat generation layer 112 of the fixing belt 110 to generate heat. The fixing belt 110 will be described in more detail later. The magnetic field generation unit 160 is constituted by an excitation circuit 161, magnetic core 162, excitation coil 163, and excitation coil holder member 164.

The magnetic core 162 is made of material having a high magnetic permeability, such as ferrite or Permalloy. The excitation circuit 161 generates an alternating current at a frequency of 20 to 500 kHz. The excitation coil 163 generates alternating magnetic flux by the alternating current supplied from the excitation circuit 161. For material of the magnetic core 162, ferrite is desirable because ferrite causes less energy loss even when an alternating current at a frequency of 100 kHz or higher flows through the excitation coil 163.

The excitation coil 163 is formed by winding of a bundle wire plural times. The bundle wire is a bundle of copper wires each coated with an insulating substance. In this embodiment, the bundle wire is wound ten turns to form the excitation coil 163. For coating of the copper wires, a heat-resistant substance such as polyamide or polyimide is desirably used in view of heat conduction of heat generated by the fixing belt 110.

The magnetic core 162 and excitation coil 163 are formed along an outer circumferential surface of the fixing belt 110. The fixing belt 110 is held so as to be maintained in a round cylindrical shape as shown in FIG. 3. In this embodiment, a distance between the outer surface of the fixing belt 110 and the excitation coil 163 is set to approximately 2 mm. For the excitation coil holder member 164, material having an excellent insulating characteristic and high heat resistance is desirable. Examples of such desirable material are, for example, phenol resin, fluororesin, polyimide, polyamide, polyamide-imide, PEEK (polyetherketone), PES (polyethersulfone), PPS (polyphenylenesulfide), PFA (tetrafluoroethylene-perfluoroalkylvinylether copolymer), PTFE (polytetrafluoroethylene), FEP (tetrafluoroethylene-hexafluoropropyrene), LCP (liquid crystal polyester), and the like.

The pad 120 is formed by bonding silicone rubber 121 to a first support member 122. In this embodiment, hardness of the silicone rubber 121 is set to 20° (JIS-A). The first support member 122 is supported by a second support member 123. The second support member 123 is so rigid that deformation caused when a load is applied from the press roller 130 may be ignored. The load from the press roller 130 will be described later. Insulating material is used for the second support member 123 in order to prevent induction heating caused by alternating magnetic flux generated by the magnetic field generation unit 160. The material for the second support member 123 is, for example, a mixture of glass resin in PPS (polyphenylenesulfide) or PET (polyethyleneterephthalate), or the like.

Figure 4A:
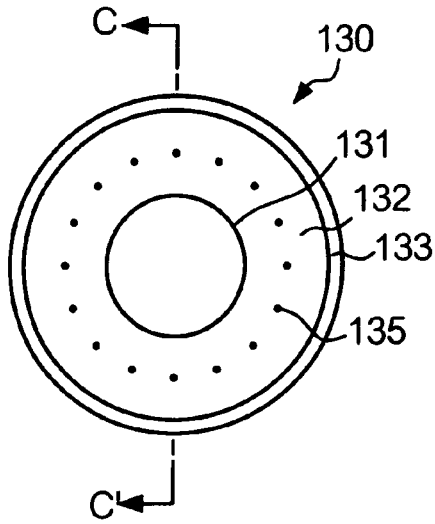
FIGS. 4A and 4B each show an end surface of a press roller 130.
Figure 5A:
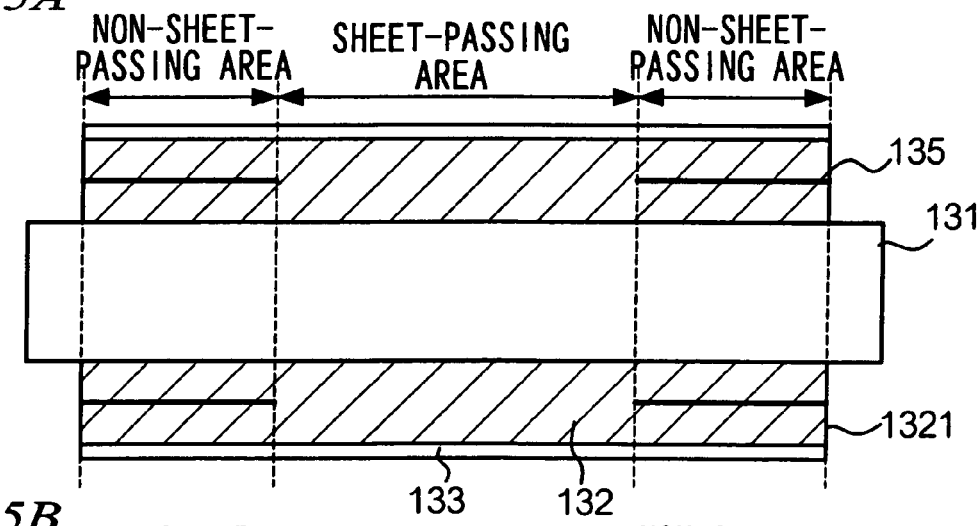
FIGS. 5A and 5B are cross-sectional views of the press roller 130.

FIG. 4A shows an end surface of the press roller 130. FIG. 5A is a sectional view cut along a line C-C' shown in FIG. 4A. The press roller 130 is constituted by a metal core 131, elastic layer 132, and release layer 133. The elastic layer 132 is formed on an outer circumferential surface of the metal core 131, and the release layer 133 is formed an outer circumferential surface of the elastic layer 132.

The metal core 131 is a round columnar member made of stainless steel. The elastic layer 132 is formed of a sponge made of silicone rubber, as a layer having a thickness of 5 mm, which covers all the outer circumferential surface of the metal core 131. Hardness of the elastic layer 132 is adjusted to 50° (Asker-C). A large number of bubbles exist dispersed in the elastic layer 132. A gas (such as air) is filled inside the bubbles. The release layer 133 is formed of PFA, as a layer having a thickness of approximately 30 μm (micrometers), which covers all the outer circumferential surface of the elastic layer 132.

As shown in FIG. 3, a fixing belt 110 is pinched between a lower surface of the pad 120 and an outer circumferential surface of the press roller 130. Springs 142 are provided hanging from an inner surface of a ceiling 141 of the casing 140, as shown in FIG. 2. Two ends of the metal core 131 of the press roller 130 are received by bearings 143 in such a manner that the press roller 130 may rotate freely. Upward force (toward the top of FIG. 2) is applied on the bearings 143 by the springs 142. With this force, the outer circumferential surface of the press roller 130 is pressed against the lower surface of the pad 120. The elastic layer 132 of the press roller 130 and the release layer 133 are formed to be elastically deformable. Therefore, a contact area having a width in circumferential directions of the press roller 130 is formed as shown in FIG. 3.

The press roller 130 is rotated in a direction denoted at an arrow B in FIG. 3 by a drive unit (not shown). As the press roller 130 rotates, friction force acts on the outer circumferential surface of the fixing belt 110. Accordingly, the inner circumferential surface of the fixing belt 110 is driven at a substantially equal speed to a circumferential speed of the press roller 130, rubbing against the lower surface of the pad 120. In this case, in order to reduce friction force generated between the lower surface of the pad 120 and the inner circumferential surface of the fixing belt 110, a lubricant such as heat-resistant grease is desirably inserted between the lower surface of the pad 120 and the inner circumferential surface of the fixing belt 110.

In this embodiment, if recording media 10 are allowed to pass through the contact area between the fixing belt 110 and the press roller 130, a conveying path for conveying the recording media 10 is defined so that the center line of each recording medium 10 passes a center point of the press roller 130 in axial directions of the press roller 130, regardless of the size of the recording medium 10. In the description given below, an area of the outer circumferential surface of the press roller 130 with which a paper sheet makes contact will be referred to as a "sheet-passing area", under a condition that a paper sheet having a B5 size according to JIS (Japan Industrial Standards) is allowed to pass through the contact area described above with the direction of major edges of the paper sheet defined as the conveying direction. On the other side, areas of the outer circumferential surface of the press roller 130 with which the paper sheet makes no contact will be referred to as "non-sheet-passing areas" under the same condition. In this case, the width of the press roller 130 in the axial directions of the press roller 130 is equal to the width of minor edges of the paper sheet having the B5 size. The non-sheet-passing areas exist respectively at two portions including end parts of the outer circumferential surface of the press roller 130. The two non-sheet-passing areas have an equal width in the axial directions of the press roller 130.

Cuts 135 for ventilation are formed in those parts of the elastic layer 132 that correspond to the non-sheet-passing areas described above. The cuts 135 each are formed by insertion and retraction of a needle-like rod in a direction parallel with the axial directions of the metal core 131 from an end surface 1321 of the elastic layer 132. The needle-like rod has a sharp tip end and a diameter of approximately 0.5 mm. In this embodiment, the cuts 135 are formed by inserting the needle-like rod at positions which are 2.5-mm distant from the outer circumferential surface of the elastic layer 132 toward the center axis of the metal core 131, as shown in FIG.

4. The cuts 135 are formed at fifty positions at constant intervals in the circumferential direction.

A large number of bubbles are dispersed in the elastic layer 132. Therefore, when the rod is inserted to form a cut 135, the tip end of the rod penetrates plural bubbles. At this time, these bubbles connect together forming a continuous space together with the cut 135. In a case of inserting a rod, the rod presses and breaks a volume of content of the elastic layer 132. The volume is equivalent to a volume of the rod. However, the content of the elastic layer 132 equivalent to the volume, which has once been pressed in, recovers to an original position after the rod is pulled out. Then, the formed cut 135 closes and bubbles return to their original positions, isolated from each other. By such a process, the cuts 135 may be configured so as to close normally and open when discharging a gas from inside of the press roller 130 during fixing operation.

Figure 6:
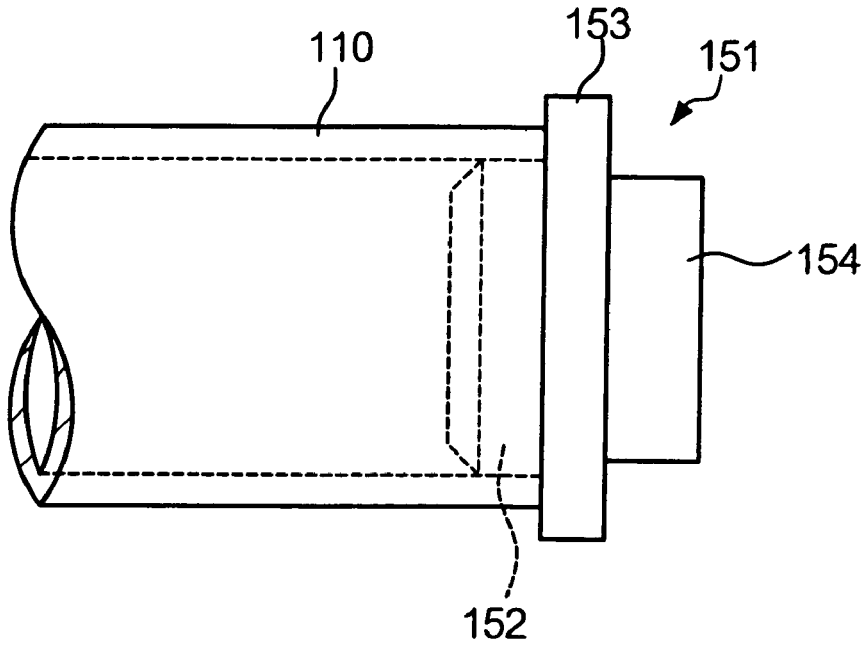
FIG. 6 shows an end part of a fixing belt 110 provided in the fixing device 100.

FIG. 6 shows a part including an end part of the fixing belt 110 provided in the fixing device 100. Edge guides 151 are provided respectively at two edge parts of the fixing belt 110. The edge guides 151 each are constituted by a round cylindrical part 152, flange 153, and a support part 154. The round cylindrical part 152 has a slightly smaller outer diameter than the outer diameter of the fixing belt 110 held by the round cylindrical part 152. Two end parts of the fixing belt 110 are brought into contact with the flanges 153 thereby to prevent meandering of the fixing belt 110. The support parts 154 are provided outside the flanges 153, respectively, and are fixed to the casing 140.

Figure 7:
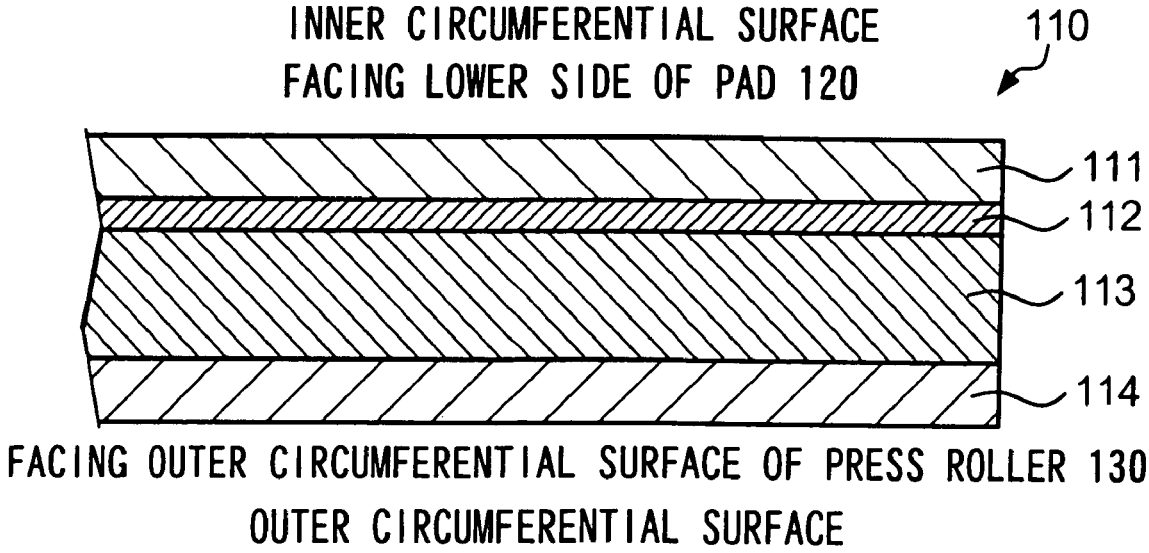
FIG. 7 shows a structure of the fixing belt 110.

FIG. 7 shows a structure of the fixing belt 110. The fixing belt 110 is a circular belt and has a layered structure including a base material layer 111, heat generation layer 112, elastic layer 113, and release layer 114 layered in this order from the inner side of the belt. To bond these layers mutually, primer layers may be inserted respectively between layers.

The base material layer 111 is formed of highly heat-resistant resin with a thickness of, for example, 10 to 100 μm (micrometers) or preferably 50 to 100 μm (micrometers). Examples of such resin are polyester, polyethyleneterephthalate, polyethersulfone, polyetherketone, polysulfone, polyimide, polyimide-amide, polyamide, and the like. This embodiment uses polyimide having a thickness of approximately 50 μm (micrometers).

A metal layer formed of iron, cobalt, nickel, copper, or chrome with a thickness of about 1 to 50 μm (micrometers) is used as the heat generation layer 112. The heat generation layer 112 is desirably formed to be as thin as possible, so that the fixing belt 110 may be deformable along the shape of the pad 120. For the heat generation layer 112, this embodiment uses highly conductive copper plated to a thickness of about 10 μm (micrometers) on the base material layer 111.

Alternating magnetic flux generated by the excitation coil 163 acts on the heat generation layer 112, so that an eddy current is generated. Accordingly, the heat generation layer 112 generates heat. The heat is transferred to toner images through the release layer 114, thereby fixing the toner images.

The elastic layer 113 is formed of silicone rubber, fluororubber, fluorosilicone rubber, or the like which has high heat resistance, and heat conductivity. In case of forming a photographed image filled with a color at a uniform density, uneven heating results if the release layer 114 cannot satisfactorily follow surface roughness of recording media or toner images. As a result, uneven brightness appears in the formed image. A part of the medium or images heated with a large heat transfer amount results in high brightness, while a part heated with a small heat transfer amount results in low brightness. If the thickness of the elastic layer 113 is set to 10 μm (micrometers) or less, the release layer 114 cannot satisfactorily follow surface roughness of recording media or toner images and requires a long time until temperature rises to a desired value. Therefore, the fixing device 100 requires a longer time to become ready for operation after instructing the fixing device to start operation. Consequently, so-called quick start is difficult. For the foregoing reasons, it is desirable that the elastic layer 113 has a thickness of 10 to 500 μm (micrometers). To maintain a higher quality for fixed images, a thickness of 50 to 500 μm (micrometers) is more desirable. In this embodiment, the thickness of the elastic layer 113 is set to approximately 300 μm (micrometers).

If the elastic layer 113 has too high hardness, the elastic layer 113 cannot satisfactorily follow the surface roughness of recording media or toner images, and allows uneven brightness to appear in fixed images. Therefore, the hardness of the elastic layer 113 is desirably set to 60° (degrees) or less (JIS-A: JIA-K A-type tester). More desirably, the hardness is set to 45° (degrees) or less.

Desirable thermal conductivity of the elastic layer 113 is $6\times10^{-4}$ to $2\times10^{-3}$ cal/cm·sec·deg.· If the thermal conductivity is smaller than $6\times10^{-4}$ cal/cm·sec·deg, thermal resistance rises to delay temperature increase in the release layer 114. If the thermal conductivity is greater than $2\times10^{-3}$ cal/cm·sec·deg, the hardness rises too much or permanent stress due to compression increases. Therefore, the thermal conductivity is desirably $6\times10^{-4}$ to $2\times10^{-3}$ cal/cm·sec·deg and more desirably $8\times10^{-4}$ to $1.5\times10^{-3}$ cal/cm·sec·deg.

For the release layer 114, it is desirable to use material having an excellent release characteristic and high thermal resistance. Examples of such desirable material are fluororesin such as PFA, PTFE, or EFP, silicone resin, silicone rubber, and fluororubber. If the thickness of the release layer 114 is set to 20 μm (micrometers) or less, uneven coating of a coated film incurs occurrence of a part having a degraded release characteristic and insufficient durability. If the thickness of the release layer 114 is set to 100 μm (micrometers) or more, the thermal conductivity deteriorates. Particularly when resin-based material is used, deformation of the elastic layer 113 cannot effectively work. In the embodiment, the thickness of the release layer 114 is set to 30 μm (micrometers).

The image forming device 1 constructed in a structure as described above operates in a manner as follows. A user sets a document on a platen glass 2, and inputs an instruction for copying the document via an instruction reception unit 41. The image input unit 12 reads the document and generates image data. This image data is supplied to the image output section 6, which forms toner images on a recording medium 10 based on the image data. The recording medium 10 with the formed toner images is conveyed to the fixing device 100. The fixing device 200 heats and presses the recording medium 10, to fix the toner images to the surface of the recording medium 10. The recording medium 10 to which toner images have been fixed is discharged to a sheet discharge unit 32.

Figure 4B:
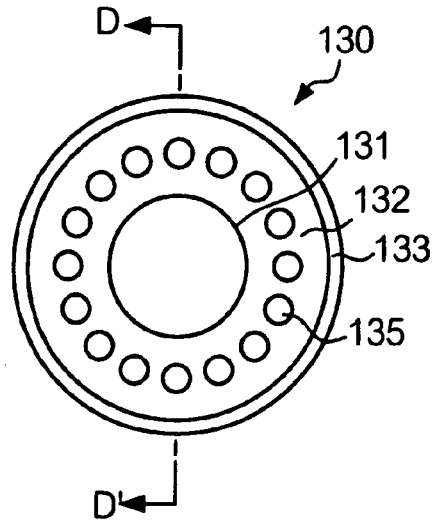
Figure 5B:
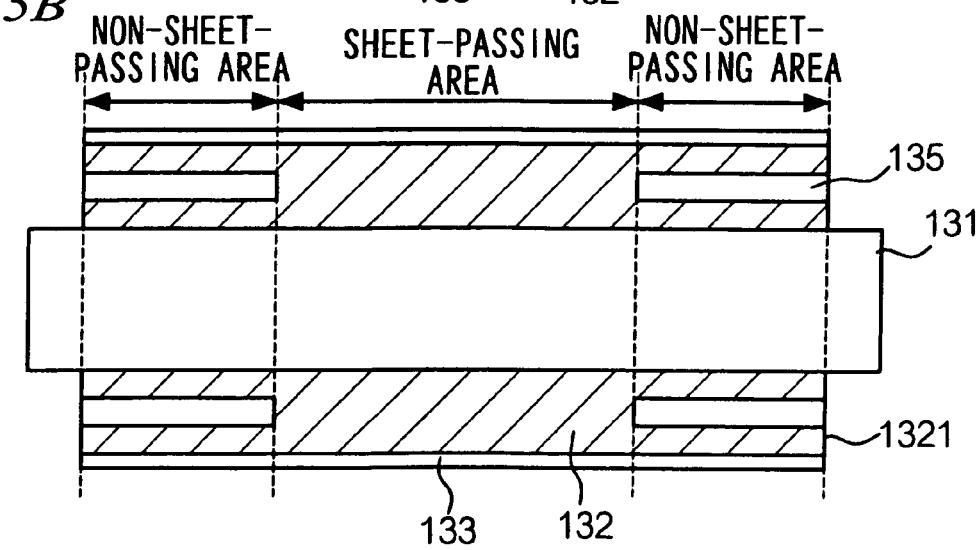

When the fixing device 100 operates, heat generated by the heat generation layer 112 of the fixing belt 110 is transferred to the press roller 130. The heat causes the elastic layer 132 to thermally expand, and increases the outer diameter of the press roller 130. This thermal expansion includes thermal expansion of the elastic layer 132 and expansion of a gas in bubbles. At this time, pressure of the gas in the bubbles has increased. The cuts 135 which normally close widen due to the thermal expansion of the elastic layer 132. FIG. 4B shows an end surface of the press roller 130. FIG. 5B is a sectional view cut along a line D-D' in FIG. 4B. In this way, the internal gas is allowed to flow between plural bubbles. Since the cuts 135 are opened in the end surface 1321 of the elastic layer 132, the gas in bubbles, pressure of which has risen, may then flow out to outside of the end surface through the cuts 135.

Described below will be results of a performance evaluation test, which is conducted on the fixing device 100 constructed in a structure as described above. In the test, the press roller 130 is pressed against the fixing belt 110 with a load of 30 kgf. Comparison with a related art is also conducted. A press roller of the related art is provided with ventilation holes, which penetrated from one to another of two end surfaces of an elastic layer. These ventilation holes each has a circular shape and a diameter of 1 mm under a condition that no heat is transferred from a fixing belt 110. In total, fifteen ventilation holes are provided at equal intervals in circumferential directions, respectively at positions which are 2.5-mm distant from the surface of the press roller toward the center of a metal core, as in the case of the press roller 130 according to the exemplary embodiment. Other features of the structure of the compared related art are the same as those of the press roller 130 according to the embodiment.

Using the press roller 130 and the related art, an image painted with toner in an amount of 10 g/m$^2$ at a uniform density is fixed at a circumferential speed of 50 mm/s, assuming a full color high quality mode. As a result of using the press roller of the related art, uneven brightness appears to a visually observable level while the press roller 130 according to the embodiment does not cause uneven brightness of a visually observable level.

Next, a test is conducted to inspect a change in outer diameter of the press roller 130 which was caused by thermal expansion. In this test, the press roller 130 of the embodiment, the press roller of the related art (hereinafter a "related art A"), and a press roller of another related art (hereinafter a "related art B") are compared. The circumferential speed of each press roller was set to 100 mm/s. A paper sheet of a B5 size having a basis weight of 105 g/m$^2$ is used, and a direction of major edges of the paper sheet is defined to be the conveying direction. Temperature of a paper-passing area of the surface of the fixing belt 110 is controlled to 150° C. Then, a total of 500 paper sheets of the same type are sequentially allowed to pass at 20 sheets/min, and a respective increase in radius of each press roller is measured at plural positions in axial directions.

Figure 8:
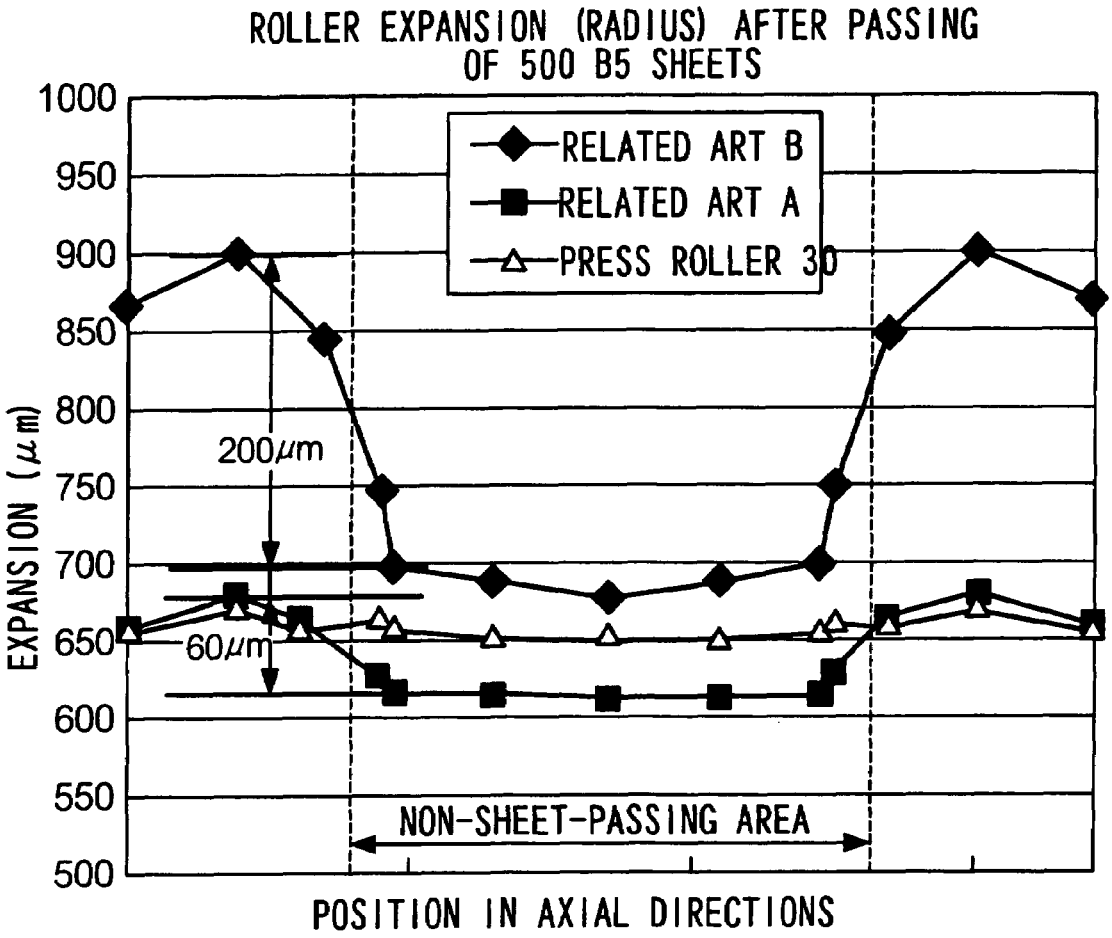
FIG. 8 shows a distribution of increase in radius of the press roller in axial directions of the press roller.

FIG. 8 shows a distribution of increases of radii in the axial directions of the three types of press rollers described above. As is apparent from the graph, in the case of the related art B, the radius at non-sheet-passing areas is greater by about 200 μm (micrometers) than at a sheet-passing area. In the case of the related art A, the radius at non-sheet-passing areas is greater by about 60 μm (micrometers) than at a sheet-passing area. In contrast, in the press roller 130 of the embodiment, the radius at non-sheet-passing areas is only slight greater than at a sheet-passing area by a much smaller difference compared with related arts A and B.

A case is now supposed of carrying out fixing operation on an A4-size paper sheet immediately after sequentially carrying out fixing operation plural times using a large amount of toner. A direction of major edges of a B5-size paper sheet is defined as the conveying direction. In this case, two end parts of the A4-size paper sheet are brought into contact with the non-sheet-passing areas described above. As described previously, the outer diameter of the press roller 130 of the embodiment does not tend to differ between a sheet-passing area and non-sheet-passing areas. Circumferential width of the contact area between the press roller 130 and the fixing belt 110 is substantially uniform in the axial directions of the press roller 130. Therefore, a heat amount and pressure, which are applied to toner images per unit area, are substantially uniform in the axial directions of the press roller 130.

In addition, the related art A has a risk of causing the outer diameter to become non-uniform in the circumferential directions of the press roller as the ventilation holes are pressed. However, the present embodiment does not incur such a risk.

MODIFICATIONS

The invention is not limited to the above exemplary embodiment but may be practiced in the form of various modifications. For example, the embodiment modified in any of the follow ways is practicable.

Modification 1

Figure 9A:
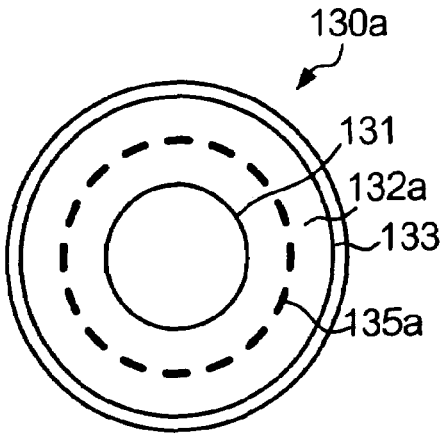
FIGS. 9A and 9B each show a press roller 130*a;*
Figure 9B:
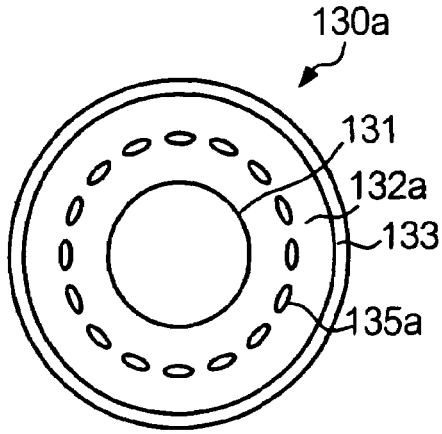

In the above embodiment, a needle-like rod having a sharp tip end is inserted in and retracted from end surfaces of the elastic layer 132, to form each cut 135. However, a method of forming the cuts is not limited to this embodiment. For example, the cuts may be formed by insertion of a plate-type object having a sharp tip into the elastic layer 132. FIG. 9A shows a press roller 130*a*

Figure 10A:
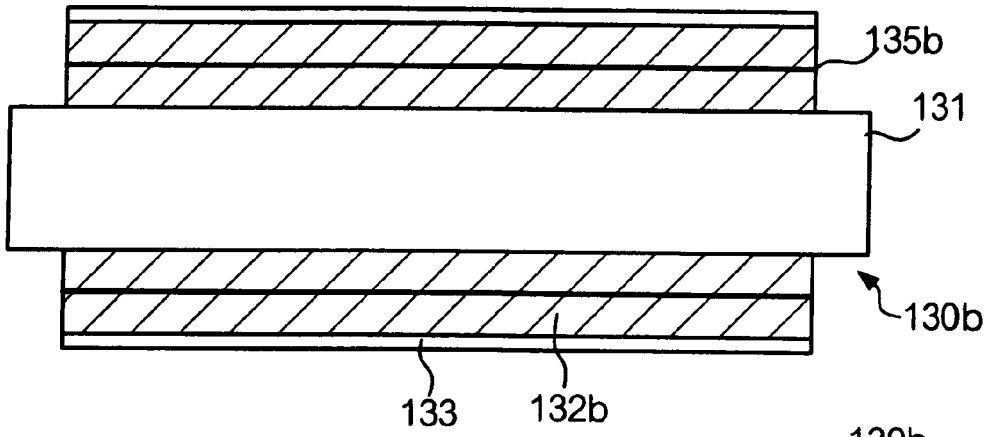
FIGS. 10A and 10B each show a press roller 130*b;*
Figure 10B:
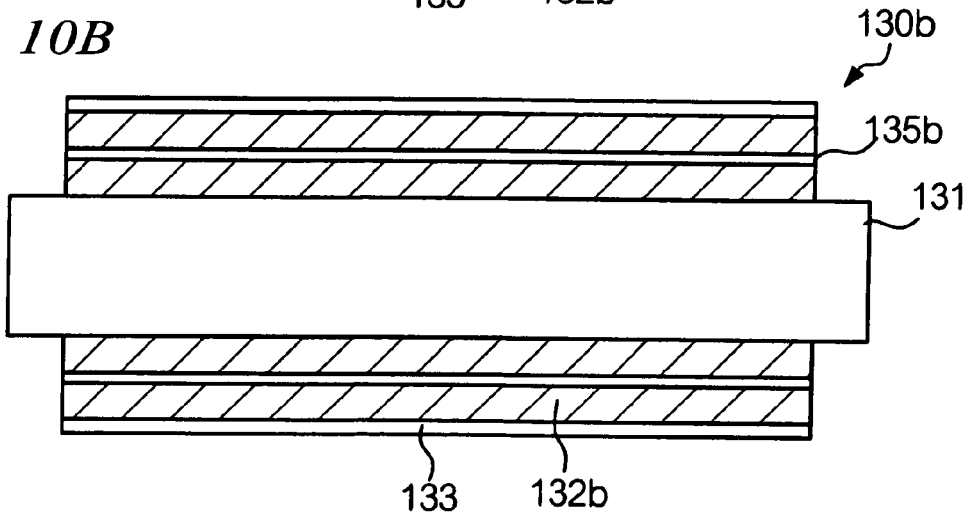

Otherwise, cuts penetrating from one to another of two end surfaces of the elastic layer may be provided by inserting a needle-like rod or plate-like object into the elastic layer. FIG. 10A shows a cross-section parallel to a rotation axis of a press roller 130*b*, which has an elastic layer 132 provided with such penetrating cuts 135*b*. Heat is transferred to the press roller 130*b* as a fixing device operates. Then, thermal expansion of the elastic layer 132 causes the cuts 135*b* to widen as shown in FIG. 10B.

Figure 11:
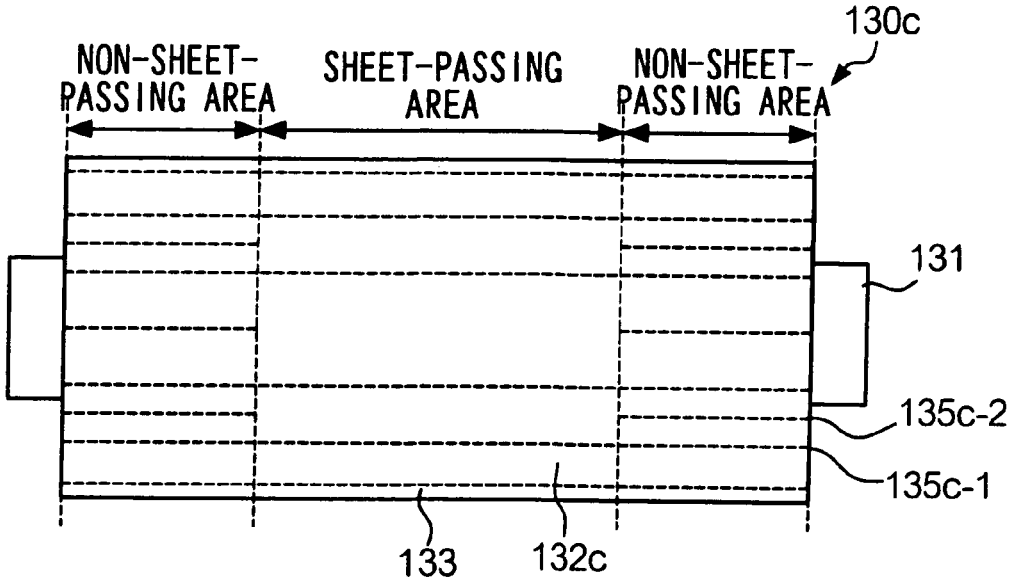
FIG. 11 shows a press roller 130*c*.

In addition to the cuts penetrating from one to another of the two end surfaces of the elastic layer, there may be provided cuts which have a predetermined length from end surfaces of the elastic layer. FIG. 11 shows a press roller 130*c* constructed to have such a structure, viewed from a direction perpendicular to the axial directions of the press roller. In this example, cuts 135*c*-1 and cuts 135*c*-2 are provided alternately in a circumferential direction of the elastic layer 132*c*, extending in the axial directions. The cuts 135*c*-1 penetrate from one to another end of two end surfaces of the elastic layer 132*c*. The cuts 135*c*-2 extend to the same length as the non-sheet-passing area of the elastic layer 132*c*.

Modification 2

Figure 12:
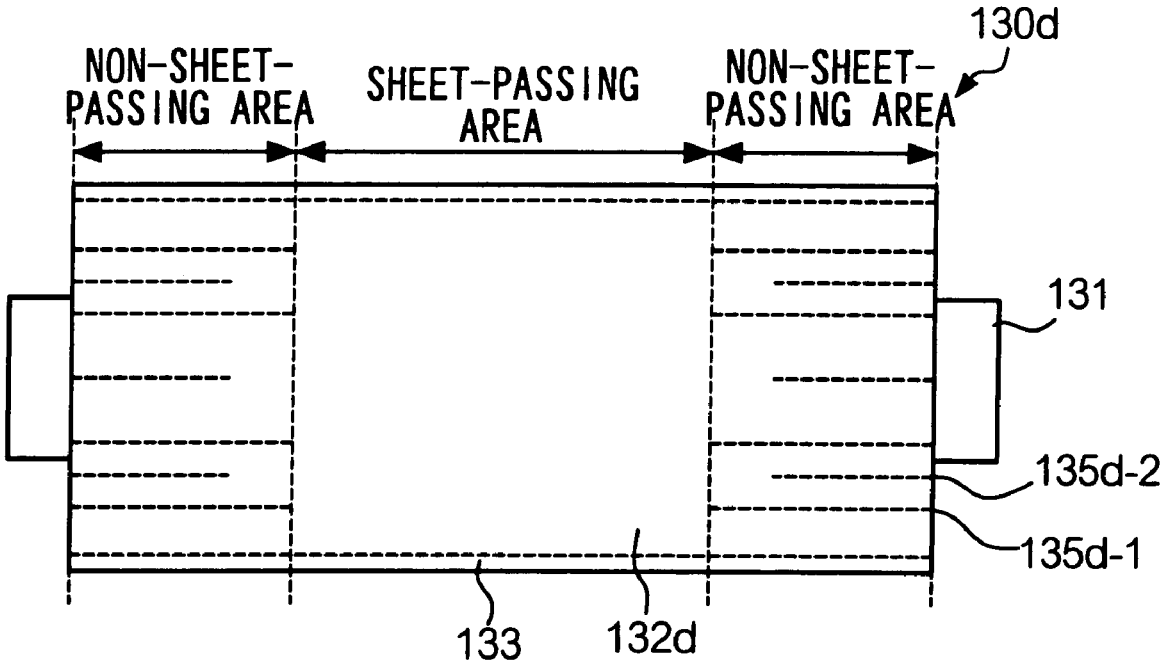
FIG. 12 shows a press roller 130*c*.

In the embodiment, plural cuts 135 having a constant length are provided under non-sheet-passing areas of the elastic layer 132. However, the cuts may be configured so that the number of cuts counted in a plane perpendicular to the axial directions of the elastic layer decreases as the plane shifts inward from an end surface of the elastic layer 132, in each of two sides of the elastic layer 132. FIG. 12 shows a press roller 130*d* constructed to have such a structure, viewed from a direction perpendicular to the axial directions. In this example, cuts 135*d*-1 and cuts 135*d*-2 are provided alternately in circumferential directions of an elastic layer 132. The cuts 135*d*-1 each extend to be as long as the entire length of each non-sheet-passing area. The cuts 135*d*-2 are shorter than the cuts 135*d*-1.

Modification 3

In the embodiment, the width of the sheet-passing area of the press roller 130 is equal to the width of minor edges of a B5-size paper sheet. However, the width of the sheet-passing area may be equal to the width of minor or major edges of a paper sheet having a different size. For example, the width of the sheet-passing area may be defined so as to match a size of paper sheets which are most frequently used.

Modification 4

The embodiment has been described referring to an example which applies the invention to a fixing device of a type using a thermal belt for fixing. However, devices to which the invention is applicable are not limited to fixing devices of the type using a thermal belt for fixing. For example, the invention is also applicable to a fixing device of a type using a heat roller for fixing, which has a heat roller with a heat source incorporated inside. In a fixing device of this type, a contact area is defined by pressing the press roller 130 described above against the heat roller. Toner images are fixed to a recording medium by causing the recording medium to pass through the contact area. According to such a structure, similar effects as obtained in the embodiment may be attained.

Modification 5

In the embodiment, the invention is applied to an electrophotographic image forming device. However, the invention may be properly applicable to any type of image forming device as long as the image forming device is of a type which heats and presses toner images formed on a recording medium, such as an image forming device using an electrostatic recording system, etc.

What is claimed is:

1. A roller comprising:

a columnar metal core; and a layer that covers, to a predetermined thickness, an outer circumferential surface of the metal core, the layer including bubbles inside, and being provided with one or more cuts penetrating the bubbles through each of end surfaces of the layer, the layer being provided with a first set of one or more cuts penetrating to a predetermined length in an axial direction of the metal core from each of the end surfaces of the layer, and a second set of one or more cuts penetrating in an axial direction of the metal core from one of the end surfaces of the layer to another one of the end surfaces of the layer.

2. The roller according to claim 1, wherein the number of the one or more cuts, as counted on a plane perpendicular to the axial direction of the layer, decreases as the plane shifts inward from each of the end surfaces.

3. A fixing device comprising:

the roller according to claim 1;

a heat member that is pressed by the roller and forms a contact area between the heat member and the roller; and a heat source that heats the heat member.

4. An image forming device comprising:

the fixing device according to claim 3;

a forming unit that forms a toner image on a recording medium; and a conveying unit that conveys the recording medium with the toner image formed by the forming unit, to the contact area between the heat member and the roller.

5. The image forming device according to claim 4, wherein length of the one or more cuts is set depending on a size of the recording medium to be used.

* * * * *